US012096840B2

(12) United States Patent
Matsuura

(10) Patent No.: US 12,096,840 B2
(45) **Date of Patent: *Sep. 24, 2024**

(54) HAIR CLIP

(71) Applicant: Matsuura co., Ltd., Tokyo (JP)

(72) Inventor: Toru Matsuura, Tokyo (JP)

(73) Assignee: Matsuura co., Ltd., Tokyo (JP)

( * ) Notice: Subject to any disclaimer, the term of this patent is extended or adjusted under 35 U.S.C. 154(b) by 107 days.

This patent is subject to a terminal disclaimer.

(21) Appl. No.: 17/173,674

(22) Filed: Feb. 11, 2021

(65) Prior Publication Data

US 2021/0251361 A1 Aug. 19, 2021

(30) Foreign Application Priority Data

Feb. 13, 2020 (JP) ..... 2020-000474 U

(51) Int. Cl.
*A45D 8/20* (2006.01)

(52) U.S. Cl.
CPC ..... *A45D 8/20* (2013.01)

(58) Field of Classification Search
CPC ..... Y10T 24/3437; Y10T 24/3433; Y10T 24/3428; A45D 8/30; A45D 8/20; A45D 8/24

See application file for complete search history.

(56) References Cited

U.S. PATENT DOCUMENTS 5,335,680 A * 8/1994 Moore ..... A45D 8/34 132/133
D473,678 S * 4/2003 Shyu ..... D28/40
D536,132 S * 1/2007 Vergona ..... D28/40
8,789,537 B2 * 7/2014 Loredo ..... A45D 8/30 132/273
D712,093 S * 8/2014 Hsu ..... D28/40
D921,292 S * 6/2021 Matsuura ..... D28/40
D939,768 S * 12/2021 Matsuura ..... D28/42
2002/0038660 A1 * 4/2002 Potut ..... A45D 8/20 132/277

(Continued)

FOREIGN PATENT DOCUMENTS

JP 3181911 2/2013
JP D1653772 * 2/2020

*Primary Examiner* — Nicholas D Lucchesi
*Assistant Examiner* — Jennifer Gill
(74) *Attorney, Agent, or Firm* — Renner, Otto, Boisselle & Sklar, LLP

(57) ABSTRACT

A problem to be solved by the present invention is to obtain a hair clip capable of holding the hair more tightly, thereby prolonging the state of the hair being clipped with the hair clip. A hair clip 1 according to the present invention is a hair clip for clipping hair, comprising: a first clip piece 110 and a second clip piece 120, for holding the hair; and a hinge member 130 for connecting the first clip piece 110 with the second clip piece 120 in an openable and closable manner, wherein the first clip piece 110 has a plurality of first teeth of generally V-shape, the plurality of first teeth including a first tooth A 110*a* and a first tooth B 110*b*, wherein the second clip piece has a plurality of second teeth of generally V-shape, the plurality of second teeth including a second tooth A 120*a* and a second tooth B 120*b*, and wherein the first tooth A 110*a* is adjacent to the second tooth A 120*a*, and the first tooth B 110*b* is adjacent to the second tooth B 120*b*.

4 Claims, 12 Drawing Sheets

(56) References Cited

U.S. PATENT DOCUMENTS

| | | | | |
|---|---|---|---|---|
| 2006/0096609 | A1* | 5/2006 | Nwokola | A45D 8/16<br>132/278 |
| 2012/0080048 | A1* | 4/2012 | Chen | A45D 8/20<br>132/277 |

* cited by examiner

HAIR CLIP

This nonprovisional application claims priority under 35 U.S.C. § 119 (a) to Japanese Utility Model Application No. 2020-474 filed in Japan on Feb. 13, 2020, the entire contents of which are hereby incorporated by reference.

BACKGROUND OF THE INVENTION

1. Field of the Invention

The present invention relates to a hair clip, and more particularly, to a hair clip having a pair of clip pieces for holding hair.

2. Description of the Related Art

As hair clips used for tying hair up, there have conventionally been hair clips each having a pair of clip pieces for holding the hair.

For example, Patent Document 1 discloses such a hair clip, and this hair clip has multiple comb teeth on each clip piece thereof. The pair of clip pieces are openably and closably connected by a hinge member so that the hair can be grasped by the plurality of comb teeth of one clip piece and the plurality of comb teeth of the other clip piece.

Reference 1: Utility Model Registration No. 3181911 Publication

SUMMARY OF THE INVENTION

With the conventional hair clips described in Patent Document 1 or the like, however, there has been a problem with the hair clipped by a hair clip, loosening due to the slipping of the hair with respect to the hair clip, where the state of the hair being clipped with the hair clip does not last long.

An objective of the present invention is to achieve a hair clip capable of holding the hair more tightly, thereby prolonging the state of the hair being clipped with the hair clip.

Means for Solving the Problems

The present invention provides the following items.

(Item 1)

A hair clip for clipping hair, comprising:

a first clip piece and a second clip piece, for holding the hair; and a hinge member for connecting the first clip piece with the second clip piece in an openable and closable manner, wherein the first clip piece has a plurality of first teeth of generally V-shape, the plurality of first teeth including a first tooth A and a first tooth B, wherein the second clip piece has a plurality of second teeth of generally V-shape, the plurality of second teeth including a second tooth A and a second tooth B, and wherein the first tooth A is adjacent to the second tooth A, and the first tooth B is adjacent to the second tooth B.

(Item 2)

The hair clip according to Item 1, wherein an apex of generally V-shape of the first tooth A is positionally shifted in an axial direction of the hinge member with respect to an apex of generally V-shape of the second tooth A, and an apex of generally V-shape of the first tooth B is positionally shifted in the axial direction of the hinge member with respect to an apex of generally V-shape of the second tooth B.

(Item 3)

The hair clip according to Item 1 or 2, wherein an apex of generally V-shape of the first tooth A is positionally shifted in a direction perpendicular to an axial direction of the hinge member with respect to an apex of generally V-shape of the second tooth A, and an apex of generally V-shape of the first tooth B is positionally shifted in the direction perpendicular to the axial direction of the hinge member with respect to an apex of generally V-shape of the second tooth B.

(Item 4)

The hair clip according to any one of Items 1 to 3, wherein an angle of the generally V-shape is in the range of about 10° to about 50°.

(Item 5)

The hair clip according to any one of Items 1 to 3, wherein an angle of the generally V-shape is in the range of about 20° to about 40°.

Effect of the Invention

According to the present invention, a hair clip can be achieved, which is capable of holding the hair more tightly, thereby prolonging the state of the hair being clipped with the hair clip.

DESCRIPTION OF THE PREFERRED EMBODIMENTS

Figure 1:
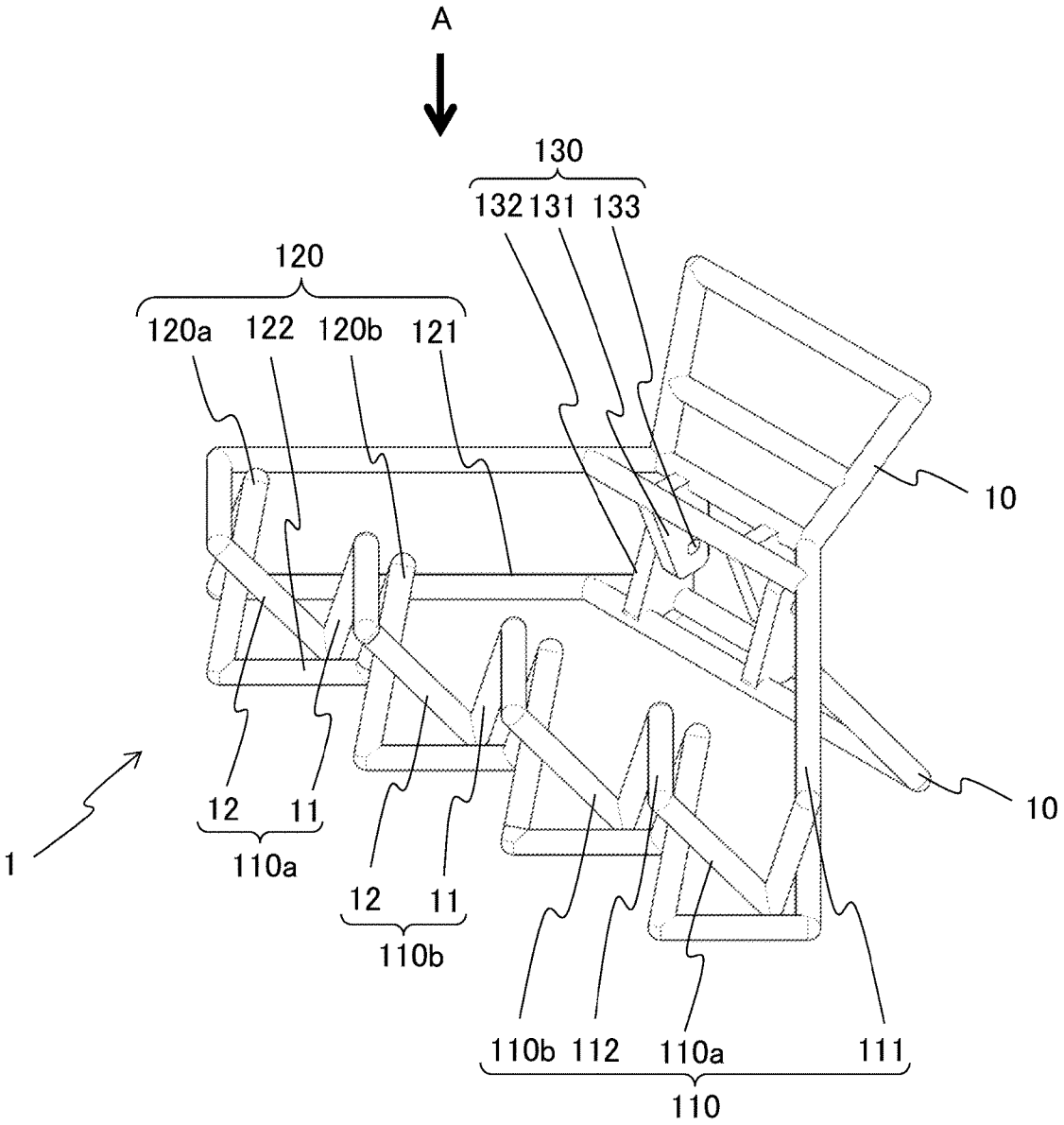
FIG. 1 is a perspective view for describing a hair clip 1 according to Embodiment 1 of the present invention.

The present invention will be described below.

As used herein, the term "about" refers to a range within +10% of the number that follows.

A problem to be solved by the hair clip according to the present invention is to provide a hair clip capable of holding the hair more tightly, thereby prolonging the state of the hair being clipped with the hair clip, and the present invention has solved the above problem by providing:

a hair clip for clipping hair, comprising:

a first clip piece and a second clip piece, for holding the hair; and a hinge member for connecting the first clip piece and the second clip piece in an openable and closable manner, wherein the first clip piece has a plurality of first teeth of generally V-shape, the plurality of first teeth including first tooth A and first tooth B, wherein the second clip piece has a plurality of second teeth of generally V-shape, the plurality of second teeth including second tooth A and second tooth B, and wherein the first tooth A is adjacent to the second tooth A, and the first tooth B is adjacent to the second tooth B.

Accordingly, the hair clip according to the present invention has a first clip piece and a second clip piece for holding the hair, the first clip piece having a plurality of first teeth of generally V-shape including first tooth A and first tooth B, the second clip piece having a plurality of second teeth of generally V-shape including second tooth A and second tooth B, in which the first tooth A is adjacent to the second tooth A, and in which the first tooth B is adjacent to the second tooth B, and the hair clip may have any remaining structures without particular limitation.

For example, the positional relationship between the first teeth and the second teeth adjacent thereto may be any relationships without particular limitation, and examples thereof include the first to fourth positional relationships below.

(First Positional Relationship)

For example, according to the hair clip of the present invention, an apex of generally V-shape of the first tooth A may be positionally shifted in the axial direction of the hinge member with respect to an apex of generally V-shape of the second tooth A, and an apex of generally V-shape of the first tooth B may be positionally shifted in the axial direction of the hinge member with respect to an apex of generally V-shape of the second tooth B.

(Second Positional Relationship)

Alternatively, according to the hair clip of the present invention, an apex of generally V-shape of the first tooth A may be positionally shifted in a direction perpendicular to the axial direction of the hinge member with respect to an apex of generally V-shape of the second tooth A, and an apex of generally V-shape of the first tooth B may be positionally shifted in a direction perpendicular to the axial direction of the hinge member with respect to an apex of generally V-shape of the second tooth B.

(Third Positional Relationship)

Alternatively, according to the hair clip of the present invention, an apex of generally V-shape of the first tooth A may be positionally shifted in the axial direction of the hinge member and further positionally shifted in a direction perpendicular to the axial direction of the hinge member with respect to an apex of generally V-shape of the second tooth A, and an apex of generally V-shape of the first tooth B may be positionally shifted in the axial direction of the hinge member and further positionally shifted in a direction perpendicular to the axial direction of the hinge member with respect to an apex of generally V-shape of the second tooth B.

(Fourth Position Relationship)

Furthermore, in addition to the first tooth A and the second tooth A being adjacent to each other as well as the first tooth B and the second tooth B being adjacent to each other, the first tooth A and the second tooth B may be adjacent to each other, and the first tooth B and the second tooth A may be adjacent to each other.

In this case, the direction in which the apex of generally V-shape of the first tooth A may be positionally shifted with respect to the apex of generally V-shape of the second tooth B and the direction in which the apex of generally V-shape of the first tooth B may be positionally shifted with respect to the apex of generally V-shape of the second tooth A, can be at least either of the axial direction of the hinge member and the direction perpendicular to the axial direction of the hinge member.

For example, an apex of generally V-shape of the first tooth A may be positionally shifted in the axial direction of the hinge member with respect to the apex of generally V-shape of the second tooth A, and an apex of generally V-shape of the first tooth B may be positionally shifted in the axial direction of the hinge member with respect to the apex of generally V-shape of the second tooth B, and furthermore, the apex of generally V-shape of the first tooth A may be positionally shifted in a direction perpendicular to the axial direction of the hinge member with respect to the apex of generally V-shape of the second tooth B, and the an apex of generally V-shape of the first tooth B may be positionally shifted in a direction perpendicular to the axial direction of the hinge member with respect to the apex of generally V-shape of the second tooth A.

(Specific Structure of First Teeth and Second Teeth of Generally V-Shape)

Furthermore, the first teeth and second teeth of generally V-shape may be in a frame body (a framework body) having a structure with a plurality of linear bodies connected with each other therein, or may be a frame body having a structure with one linear body being bent therein.

For example, the first teeth and the second teeth each may have a structure in which one end of a first straight frame is joined with one end of a second straight frame so that the first straight frame and the second straight frame together can form a V shape, or may have a structure in which one straight frame is bent at the central portion thereof so as to form a V shape.

Furthermore, the angles of the generally V-shape formed by the first teeth and the second teeth are not particularly limited.

However, as the angle of the generally V-shape increases, the apexes of generally V-shape move away from each other between the adjacent first and second teeth, where more hair can be held between the lateral edges of the adjacent first and second teeth, while the force to press the hair being held between the lateral edges of the adjacent first and second teeth becomes weaker. On the contrary, as the angle of the generally V-shape decreases, the apexes of generally V-shape move closer to each other between the adjacent first and second teeth, where the force to press the hair being held between the lateral edges of the adjacent first and second teeth becomes stronger, while less hair (i.e., the hair on which the hair clip stands) can be held between the lateral edge of the adjacent first teeth and second teeth, resulting in a making the hair clip unstable thereon.

The angle of the generally V-shape is thus set in a predetermined range, such as, a range of about 10° to about 50°, and a more preferable range for the control of loosening of the hair clip attached to the hair is in the range of about 20° to about 40°.

(Specific Structure of First Clip Piece and Second Clip Piece)

The first clip piece having a plurality of first teeth, and the second clip piece having a plurality of second teeth may have an identical structure. Alternatively, the structure of the first clip piece having a plurality of first teeth may differ from the structure of the second clip piece having a plurality of second teeth. For example, the disposition of the plurality of first teeth may differ from the disposition of the plurality of second teeth, or the angle of the first teeth of generally V-shape may differ from the angle of the second teeth of generally V-shape.

The first clip piece has a plurality of first teeth and a first base for supporting the plurality of first teeth, and the second clip piece has a plurality of second teeth and a second base for supporting the plurality of second teeth. In addition to the above, the first clip piece may have such first teeth where adjacent first teeth are connected to each other via a first interconnect portion or where adjacent first teeth are directly connected to each other. Similarly, the second clip piece may have such second teeth where adjacent second teeth are connected to each other via a second interconnect portion or where adjacent second teeth are directly connected to each other. Furthermore, the first clip piece may have such first teeth where a first tooth is coupled to a first base via a first base coupling portion or where a first tooth is directly connected to a first base. Similarly, the second clip piece may have such second teeth where a second tooth is connected to a second base via a second base connecting portion or where a second tooth is directly connected to a second base.

The constituent materials of the first clip piece and second clip piece are not limited, and metal, plastic, hard rubber, ceramic, and the like can be used as the materials. As for the metal material, aluminum, for example, is effective for weight reduction, and metal materials such as stainless steel and titanium are effective for suppressing metal allergies.

In Embodiments 1 to 6 below, however, the first clip piece and the second clip piece have the same structure, and in the hair clips according to any of the embodiments, the first clip piece has a plurality of first teeth and a first base for supporting the plurality of first teeth, and the second clip piece has a plurality of second teeth and a second base for supporting the plurality of second teeth.

Embodiments 1 and 2 share in common that the positional relationship between the first teeth and the second teeth corresponds to the above-mentioned first positional relationship. However, Embodiment 1 differs from Embodiment 2 in that: in Embodiment 1, only the first teeth (second teeth) at both ends of a first clip piece (second clip piece) are connected to a base frame, while the remaining teeth, other than the first teeth (second teeth) at both ends, are not connected to the base frame, where adjacent first teeth (second teeth) are connected to each other; whereas in Embodiment 2, a plurality of first teeth (second teeth) in the first clip piece (second clip piece) of the hair clip are all connected to a base frame.

Embodiments 3 to 6 share in common that the positional relationship between the first teeth and the second teeth corresponds to the above-mentioned fourth positional relationship.

Embodiments 3 and 4 also share in common that a plurality of first teeth (second teeth) are all connected to a base frame in a first clip piece (second clip piece) of a hair clip, forming a first dentition (the row farther from the axis of the hinge member), in which the first tooth and the second tooth are alternately arranged, and a second dentition (the row closer to the axis of the hinge member), in which the first tooth and the second tooth are alternately arranged. However, Embodiment 3 differs from Embodiment 4 in that the length of the first dentition is the same as that of the second dentition in Embodiment 3, whereas the first dentition (the row farther from the axis of the hinge member) is longer than the second dentition (the row closer to the axis of the hinge member) in Embodiment 4.

Embodiments 5 and 6 share in common that only the first teeth (second teeth) at both ends of a first clip piece (second clip piece) are connected to a base frame, while the remaining teeth, other than the first teeth (second teeth) at both ends, are not connected to the base frame, where adjacent first teeth (second teeth) are connected to each other, whereas Embodiment 5 differs from Embodiment 6 in that Embodiment 6 includes a reinforcing frame provided therein, which is not provided in Embodiment 5.

Hereinafter, embodiments of the present invention will be described with reference to the accompanying drawings.

Embodiment 1

FIG. 1 is a perspective view for describing a hair clip 1 according to Embodiment 1 of the present invention.

The hair clip 1 is a hair clip for clipping hair, and the hair clip 1 has a first clip piece 110, a second clip piece 120, and a hinge member 130 for connecting the first clip piece 110 and the second clip piece 120 in an openable and closable manner. Note that FIG. 1 shows the constituent members of the second clip piece 120 colored in gray in order to clearly distinguish the first clip piece 110 from the second clip piece 120. Furthermore, the constituent members of the second clip piece are similarly colored in FIGS. 3, 5, 7, 9 and 11 referred to below.

Herein, the first clip piece 110 and the second clip piece 120 constitute a pair of clip pieces for holding the hair by the rotational movement around the axis Ax (see FIG. 2) of the hinge member 130. Note that while the first clip piece 110 has the same structure as the second clip piece 120 in Embodiment 1, the first clip piece 110 and the second clip piece 120 may have structures that are different from each other. For example, the first clip piece 110 and the second clip piece 120 may have such first teeth and second teeth, the shapes of which are different from each other, or the arrangement of a plurality of first teeth may be different from the arrangement of a plurality of second teeth.

Hereinafter, the first clip piece 110, the second clip piece 120, and the hinge member 130 of the hair clip 1 will be described specifically.

(First Clip Piece 110)

The first clip piece 110 has a plurality of first teeth, and a base for supporting the plurality of first teeth. Herein, the base is a frame body (base frame) 111 formed by joining a plurality of linear frames. A first bearing portion 131, which constitutes the hinge member 130, is attached to part of the base frame 111.

The plurality of first teeth include a plurality of first teeth A and a plurality of first teeth B, where the plurality of first teeth A are two outer first teeth 110*a* located at both ends of the first clip piece 110 and where the plurality of first teeth B are two inner first teeth 110*b* located between the two outer first teeth 110*a*. The two outer first teeth 110*a* and the two inner first teeth 110*b* have the same, generally V-shape.

For example, the outer first tooth 110*a* is formed by joining one end of a first straight frame piece 11 with one end of a second straight frame piece 12 in such a manner that the frame pieces 11 and 12 form a generally V-shape. The two outer first teeth 110*a* and the two inner first teeth 110*b* are arranged in a direction parallel to the direction Dx (see FIG. 2) of the axis Ax (hinge axial direction) of the first bearing portion 131.

Herein, as a specific shape of the generally V-shape, a shape is used in which the dimension in the width direction of the V-shape is about 1 cm and the dimension in the height direction of the V-shape is about 2 cm to about 2.5 cm, so that the angle of the generally V-shape is in the range of about 22° to about 28°. As an example of the generally V-shape, when the dimension in the width direction of the V-shape is about 1 cm and the dimension in the height direction of the V-shape is about 2.25 cm, the angle of the generally V-shape is about 25°.

Herein, the specific dimensions of the generally V-shape, that is, the dimension in the width direction and the dimension in the height direction of the V-shape are not limited to the above dimensions. Accordingly, the angle of the generally V-shape may also be an angle in the range of about 20° to about 40°, which is wider than the above range of about 22° to about 28°, or an angle in the range of about 10° to about 50°, which is even wider.

Herein, one end of each of the two outer first teeth 110*a* is connected to the base frame 111, one end of one of the two inner first teeth 110*b* is connected to one end of the other one of the two inner first teeth 110*b* by a coupling frame 112, and one end of the inner first tooth 110*b* is connected to one end of the outer first tooth 110*a* adjacent thereto by a coupling frame 112.

(Second Clip Piece 120)

The second clip piece 120 also has the same structure as the first clip piece 110, where the second clip piece 120 has outer second teeth 120*a*, inner second teeth 120*b*, a base frame 121, coupling frames 122, and second bearing portions 132, which correspond to the outer first teeth 110*a*, inner first teeth 110*b*, base frame 111, coupling frames 112, and first bearing portions 131 of the first clip piece 110, respectively.

(Hinge Member 130)

The hinge member 130 is a member for connecting the first clip piece 110 with the second clip piece 120 in a rotatable manner. Herein, the hinge member includes a first bearing portion 131 attached to a base frame 111 of a first clip piece 110, a second bearing portion 132 attached to a base frame 121 of a second clip piece 120, and a support shaft portion 133, the structure of the hinge member 130 being that the first bearing portion 131 and the second bearing portion 132 are rotatably supported by the support shaft portion 133, and a spring member (not shown) urges the pair of clip pieces in the closing direction. In addition, the base frames 111 and 121 each are formed with a grip portion 10 for opening a pair of clip pieces against the urging force of the spring.

In the hair clip 1 as described above, the positional relationship between the plurality of first teeth and the plurality of second teeth in a state where the hair is held between the first clip piece 110 and the second clip piece 120 will be such a relationship as described below.

Figure 2:
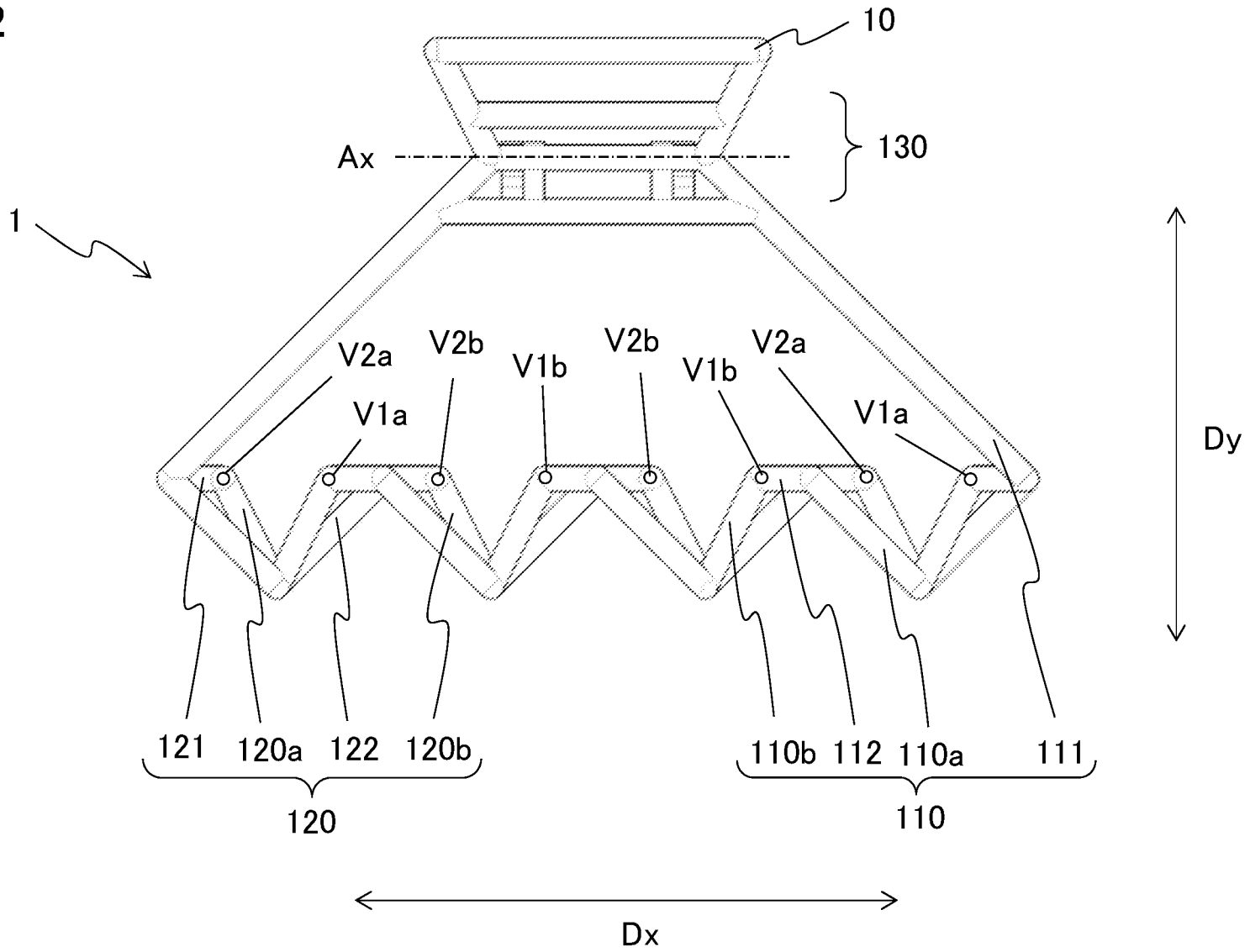
FIG. 2 is a plan view of the hair clip 1 shown in FIG. 1 as viewed from the direction A, showing the positions of apexes of generally V-shaped teeth in a pair of clip pieces 110 and 120 constituting the hair clip 1.

FIG. 2 is a plan view of the hair clip 1 shown in FIG. 1 as viewed from the direction A, showing the positions of the apexes of the generally V-shaped first and second teeth in a pair of clip pieces 110 and 120 constituting the hair clip 1.

In the hair clip 1, with regard to a generally V-shaped apex V1*a* of an outer first tooth (first tooth A) 110*a* of the first clip piece 110 and a generally V-shaped apex V2*a* of an outer second tooth (second tooth A) 120*a* of the second clip piece 120, the generally V-shaped apexes are positionally shifted in the axial direction Dx of the hinge member 130; and with regard to a generally V-shaped apex V1*b* of an inner first tooth (first tooth B) 110*b* of the first clip piece 110 and a generally V-shaped apex V2*b* of an inner second tooth (second tooth B) 120*b* of the second clip piece 120, the generally V-shaped apexes are positionally shifted in the axial direction (hinge axial direction) Dx of the hinge member 130.

As described above, the apex of the first tooth of generally V-shape and the apex of the second tooth of generally V-shape are positionally shifted in the hinge axial direction Dx in between the first clip piece 110 and the second clip piece 120, so that the hair can be held between the side portion of the first tooth and the side portion of the second tooth, which are inclined with respect to the direction in which the pair of clips hold the hair, where the force with which the first tooth and the second tooth hold the hair is amplified more than the force with which the pair of clips press the hair down. This allows tighter holding of the hair, whereby resulting in prolonging the state of the hair being clipped with the hair clip.

Additionally, in the hair clip 1 of Embodiment 1, the first teeth 110*a* and 110*b* of the first clip piece 110, and the second teeth 120*a* and 120*b* of the second clip piece 120 are arranged in a row parallel to the hinge axis Ax. This allows narrowing of the width of the area where the opposing first and second teeth are arranged in the hair clip 1, thereby reducing the dimension of the hair clip 1 in a direction Dy perpendicular to the hinge axis Ax.

In Embodiment 1, the hair clip 1 has been shown, in which the respective, generally V-shaped apexes are positionally shifted in the hinge axial direction Dx between the outer first tooth 110*a* (first tooth A) of the first clip piece 110 and the outer second tooth 210*a* (second tooth A) of the second clip piece 120 and in which the respective, generally V-shaped apexes are positionally shifted in the hinge axial direction Dx between the inner first tooth 110*b* (first tooth B) of the first clip piece 110 and the inner second tooth 120*b* (second tooth B) of the second clip piece 120. However, the direction in which the first tooth A and second tooth A are positionally shifted is not limited to the hinge axial direction Dx, and such a direction may be a direction Dy perpendicular to the hinge axial direction Dx, or both the hinge axial direction Dx and the direction Dy perpendicular thereto. In addition, the direction in which the first tooth B and second tooth B are positionally shifted is not limited to the hinge axial direction Dx, and such a direction may be a direction Dy perpendicular to the hinge axial direction Dx, or both the hinge axial direction Dx and the direction Dy perpendicular thereto.

In Embodiment 1, only the first teeth (second teeth) at both ends of a first clip piece (second clip piece) are connected to a base frame, while the remaining teeth, other than the first teeth (second teeth) at both ends, are not connected to the base frame, where adjacent first teeth (second teeth) are connected to each other. However, all the plurality of first teeth (second teeth) in the first clip piece (second clip piece) of the hair clip may be individually connected to the base frame, and a hair clip with such a configuration will be described hereinafter as Embodiment 2 below.

Embodiment 2

Figure 3:
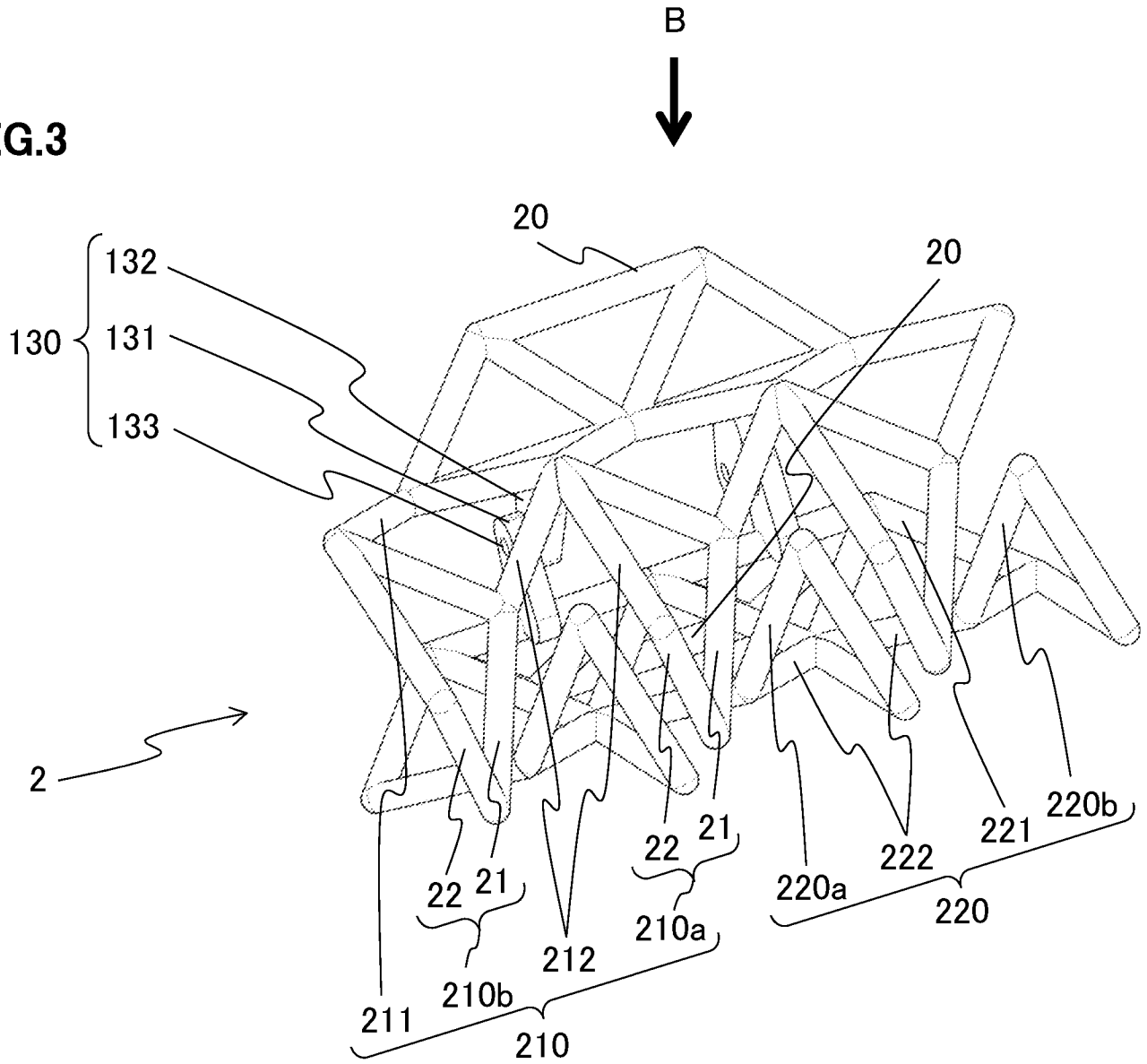
FIG. 3 is a perspective view for describing a hair clip 2 according to Embodiment 2 of the present invention.

FIG. 3 is a perspective view for describing a hair clip 2 according to a second embodiment of the present invention.

The hair clip 2 comprises first and second clip pieces 210 and 220, which correspond to the first and second clip pieces 110 and 120 in the hair clip 1 according to Embodiment 1. The hinge member 130 of the hair clip 2 is identical to the one in Embodiment 1.

(First Clip Piece 210)

The first clip piece 210, similarly to the first clip piece 110 in Embodiment 1, has a plurality of first teeth, and a base for supporting the plurality of first teeth.

Herein, the base is a frame body (base frame) 211 formed by joining a plurality of linear frames. A first bearing portion 131, which constitutes the hinge member 130, is attached to an end of the base frame 211, and a grip portion 20 is formed on the base frame 211.

Figure 4:
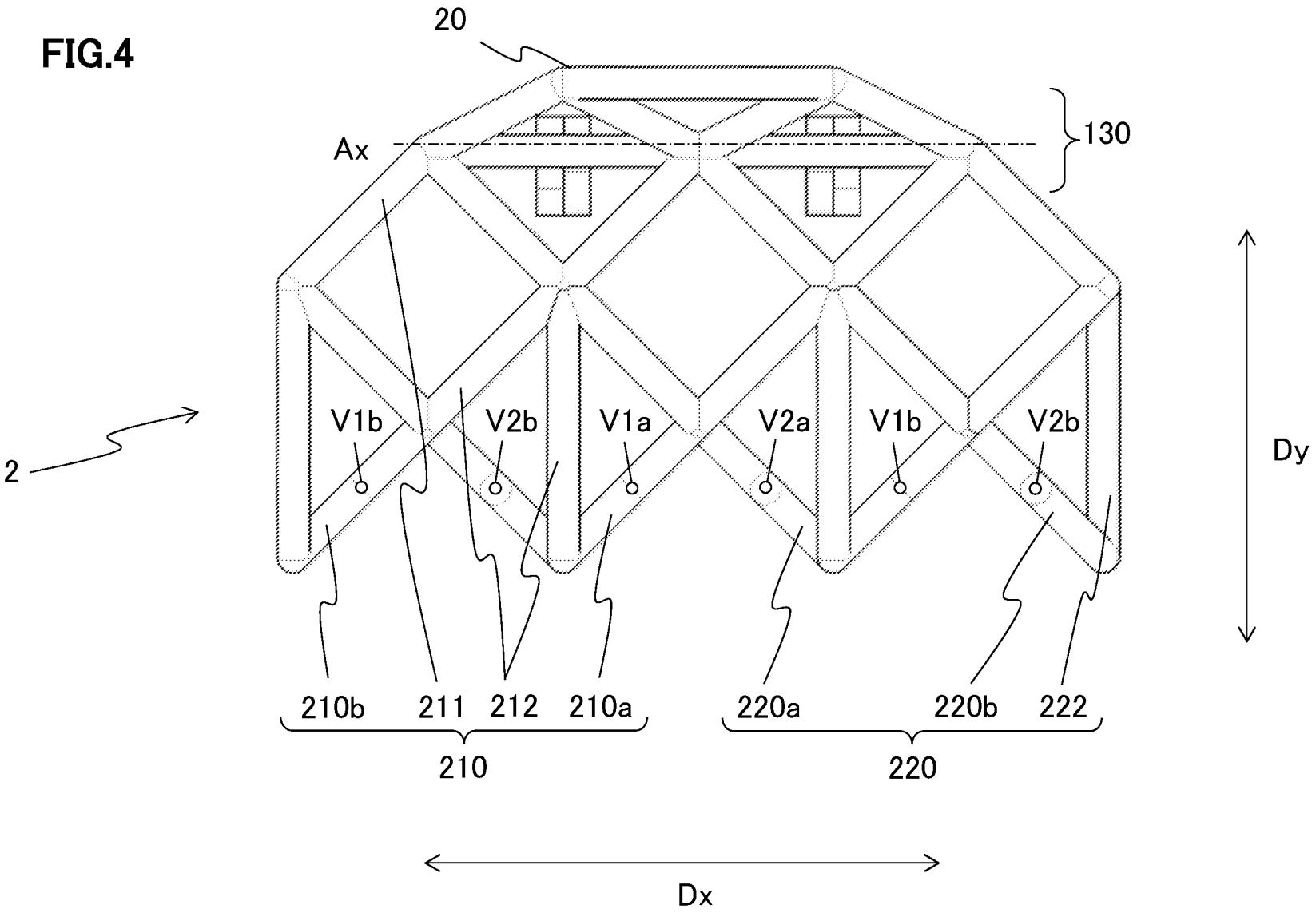
FIG. 4 is a plan view of the hair clip 2 shown in FIG. 3 as viewed from the direction B, showing the positions of apexes of generally V-shaped teeth in a pair of clip pieces 210 and 220 constituting the hair clip 2.

The first clip piece 210 includes three, first teeth arranged along the hinge axial direction Dx of the hinge member 130 (see FIG. 4). Herein, the three, first teeth include one central first tooth (first tooth A) 210*a* located in the center and two lateral first teeth (first tooth B) 210*b* located on both sides thereof. Each of the three, first teeth is connected to the base frame 211 via a coupling frame 212.

The one central first tooth 210*a* and two lateral first teeth 210*b* have the same generally V shape.

For example, the central first tooth 210*a* is formed by joining one end of a first straight frame piece 21 with one end of a second straight frame piece 22 in such a manner that the frame pieces 21 and 22 form a generally V-shape. Note that the angle of the generally V-shape of the central first tooth 210*a* is identical to the angle of the first tooth in the hair clip 1 according to Embodiment 1.

(Second Clip Piece 220)

The second clip piece 220 also has the same structure as the first clip piece 210, and the second clip piece 220 has a central second tooth 220*a*, lateral second teeth 220*b*, a base frame 221, coupling frames 222, and a second bearing portion 132, which correspond to the central first tooth 210*a*, lateral first teeth 210*b*, base frame 211, coupling frames 212, and the first bearing portion 131 of the first clip piece 210, respectively.

In the hair clip 2 as described above, the positional relationship between the plurality of first teeth and the plurality of second teeth in a state where the hair is held between the first clip piece 210 and the second clip piece 220 will be such a relationship as described below.

FIG. 4 is a plan view of the hair clip 2 shown in FIG. 3 as viewed from the direction B, showing the positions of the apexes of the generally V-shaped teeth in a pair of clip pieces 210 and 220 constituting the hair clip 2.

In the hair clip 2, a generally V-shaped apex V1*a* of a central first tooth (first tooth A) 210*a* of the first clip piece 210 and a generally V-shaped apex V2*a* of a central second tooth (second tooth A) of the second clip piece 220, are positionally shifted in the axial direction Dx of the hinge member 130. A generally V-shaped apex V1*b* of a lateral first tooth (first tooth B) 210*b* of the first clip piece 210 and a generally V-shaped apex V2*b* of a lateral second tooth (second tooth B) 220*b* of the second clip piece 220, are positionally shifted in the axial direction Dx of the hinge member 130.

In the hair clips 2 according to Embodiment 2 with such a configuration, the first teeth 210*a* and 210*b* of the first clip piece 210 are all individually connected to the base frame 210 by the coupling frame 212, and the second teeth 220*a* and 220*b* of the second clip piece 220 are all individually connected to the base frame 220 by the coupling frame 222. Accordingly, in addition to the effect of the hair clip 1 according to Embodiment 1, the first teeth 210*a* and 210*b* and the second teeth 220*a* and 220*b* can be controlled from being displaced with respect to the base frames 211 and 221 when the first clip piece 210 and the second clip piece 220 hold the hair therebetween.

The positions of the generally V-shaped apexes of the first and second teeth in the hair clip may be, without limitation to those arranged in one row as in the hair clips according to Embodiments 1 and 2, arranged in two rows. In the following embodiments, hair clips will be described, in which the positions of generally V-shaped apexes of a plurality of first teeth and a plurality of second teeth in such hair clips are arranged in two rows along the hinge axial direction Dx.

Embodiment 3

Figure 5:
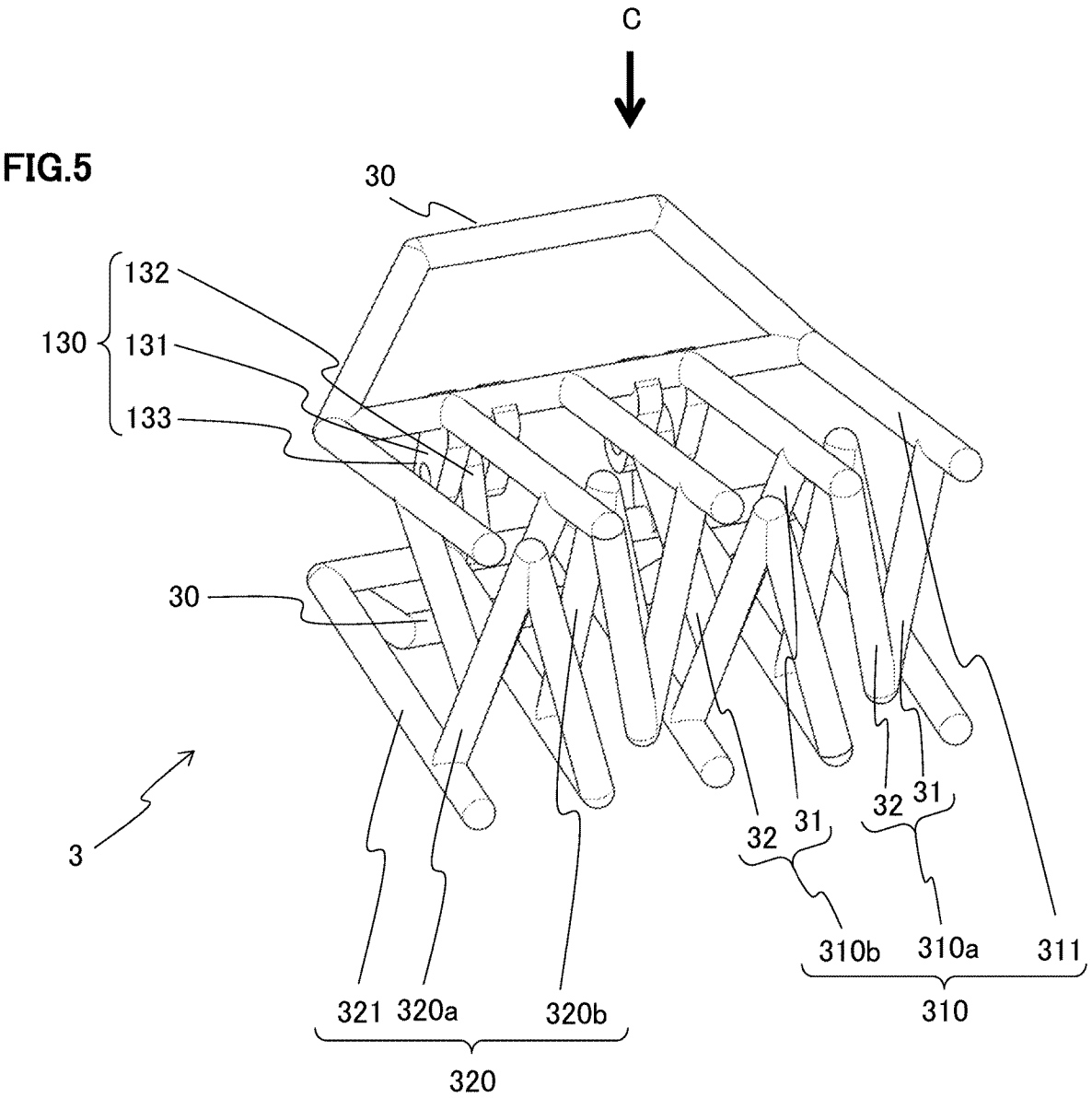
FIG. 5 is a perspective view for describing a hair clip 3 according to Embodiment 3 of the present invention.

FIG. 5 is a perspective view for describing a hair clip 3 according to Embodiment 3 of the present invention.

The hair clip 3 comprises first and second clip pieces 310 and 320, which correspond to the first and second clip pieces 110 and 120 in the hair clip 1 according to Embodiment 1. The hinge member 130 of the hair clip 3 is identical to the one in Embodiment 1.

(First Clip Piece 310)

The first clip piece 310, similarly to the first clip piece 110 in Embodiment 1, has a plurality of first teeth, and a base for supporting the plurality of first teeth.

Herein, the base is a frame body (base frame) 311 formed by joining a plurality of linear frames. A first bearing portion 131, which constitutes the hinge member 130, is attached to an end of the base frame 311, and a grip portion 30 is formed on the base frame 311.

Figure 6:
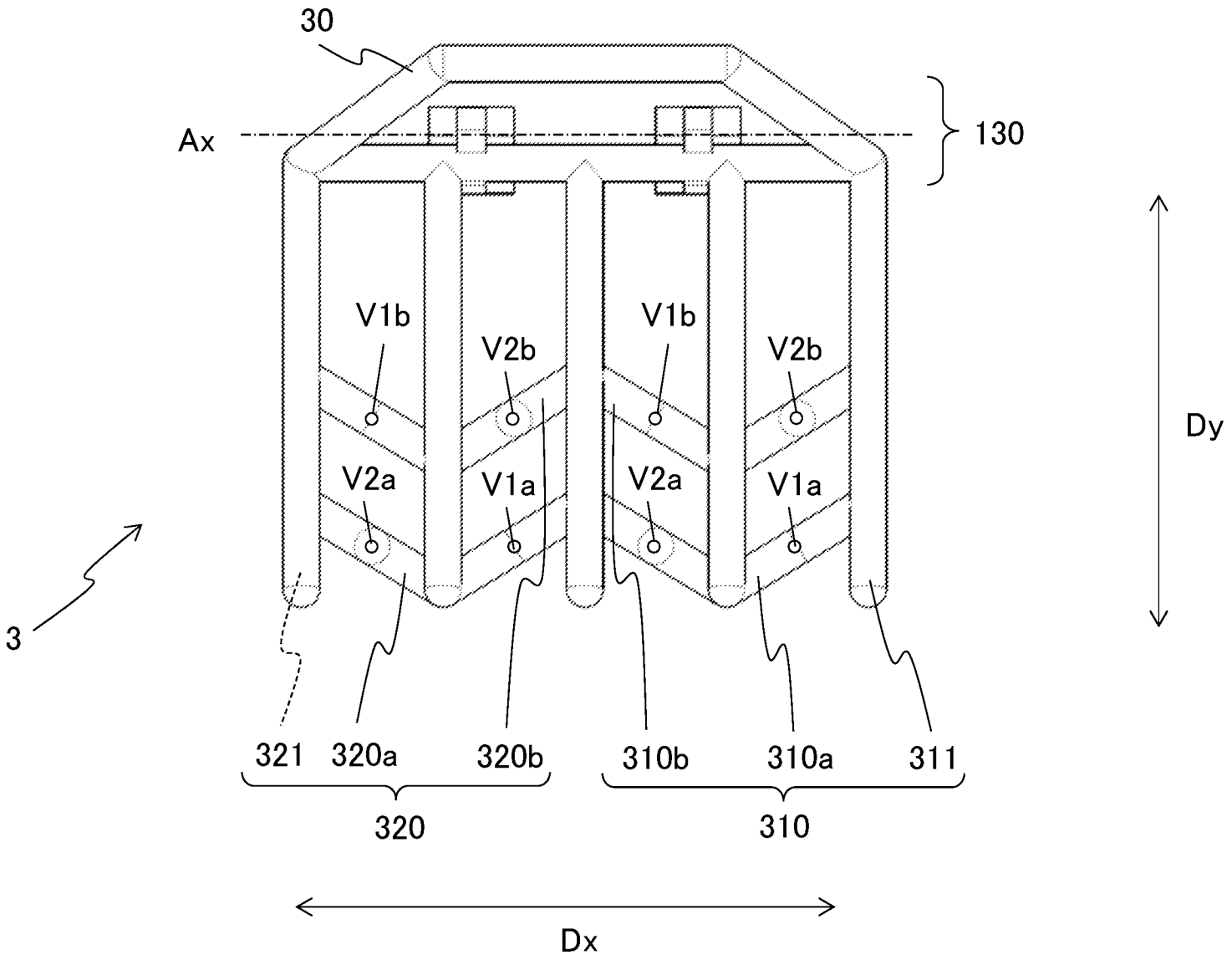
FIG. 6 is a plan view of the hair clip 3 shown in FIG. 5 as viewed from the direction C, showing the positions of apexes of generally V-shaped teeth in a pair of clip pieces 310 and 320 constituting the hair clip 3.

The first clip piece 310 includes four, first teeth arranged in two rows in a staggered manner along the hinge axial direction Dx of the hinge member 130 (see FIG. 6). Herein, the four, first teeth include two outer first teeth (first teeth A) 310*a* and two inner first teeth (first teeth B) 310*b*, where the two outer first teeth 310*a* form the outer arrangement farther from the first bearing 131 in the two-row arrangement, while the two inner first teeth 310*b* form the inner arrangement closer to the first bearing 131 in the two-row arrangement.

The two outer first teeth 310*a* and the two inner first teeth 310*b* all have a generally V shape.

For example, the outer first tooth 310*a* is formed by joining one end of a first straight frame piece 31 with one end of a second straight frame piece 32 in such a manner that the frame pieces 31 and 32 form a generally V shape. Note that the angle of the generally V-shape of the outer first tooth 310*a* is identical to the angle of the first tooth in the hair clip 1 according to Embodiment 1.

(Second Clip Piece 320)

The second clip piece 320 also has the same structure as the first clip piece 310, and the second clip piece 320 has outer second teeth (second teeth A) 320*a*, inner second teeth (second teeth B) 320*b*, a base frame 321 and a second bearing portion 132, which correspond to the outer first teeth 310*a*, inner first teeth 310*b*, base frame 311 and first bearing portion 131 of the first clip piece 310, respectively.

In the hair clip 3 as described above, the positional relationship between the plurality of first teeth and the plurality of second teeth in a state where the hair is held between the first clip piece 310 and the second clip piece 320 will be such a relationship as described below.

FIG. 6 is a plan view of the hair clip 3 shown in FIG. 5 as viewed from the direction C, showing the positions of apexes of generally V-shaped teeth in a pair of clip pieces 310 and 320 constituting the hair clip 3.

In the hair clip 3, a generally V-shaped apex V1*a* of an outer first tooth (first tooth A) 310*a* of the first clip piece 310 and a generally V-shaped apex V2*a* of an outer second tooth (second tooth A) 320*a* of the second clip piece 320, are positionally shifted in the axial direction Dx of the hinge member 130. A generally V-shaped apex V1*b* of an inner first tooth (first tooth B) 310*b* of the first clip piece 310 and a generally V-shaped apex V2*b* of an inner second tooth (second tooth B) 320*b* of the second clip piece 320 are positionally shifted in the axial direction Dx of the hinge member 130.

Furthermore, the generally V-shaped apex V1*a* of the outer first tooth (first tooth A) 310*a* and the generally V-shaped apex V2*b* of the inner second tooth (second tooth A) 320*b* of the second clip piece 320 are positionally shifted in a direction Dy perpendicular to the axial direction of the hinge member 130, and the generally V-shaped apex V1*b* of the inner first tooth (first tooth B) 310*b* and the generally V-shaped apex V2*a* of the outer second tooth (second tooth A) 320*a* are positionally shifted in a direction Dy perpendicular to the axial direction of the hinge member 130.

In the hair clip 3 according to Embodiment 3 with such a configuration, the adjacent first tooth A and second tooth A are positionally shifted in the axial direction Dx of the hinge member 130, and the adjacent first tooth B and second tooth B are positionally shifted in the axial direction Dx of the hinge member 130, and furthermore, the adjacent first tooth A and second tooth B are positionally shifted in the direction Dy perpendicular to the axial direction of the hinge member 130, and the adjacent first tooth B and second tooth A are positionally shifted in the direction Dy perpendicular to the axial direction of the hinge member 130. This allows even tighter holding of the hair with: the first and second teeth shifted in the axial direction Dx of the hinge member 130; and the first and second teeth shifted in the direction Dy perpendicular to the axial direction of the hinge member 130, whereby resulting in prolonging the state of the hair being clipped with the hair clip even longer.

In Embodiment 3, arrangement of the first and second teeth and the other arrangement of the first and second teeth have been shown to be of the same length. However, such arrangement of the first and second teeth may be longer than the other arrangement of the first and second teeth, and a hair clip with such a configuration will be described in Embodiment 4 below.

Embodiment 4

Figure 7:
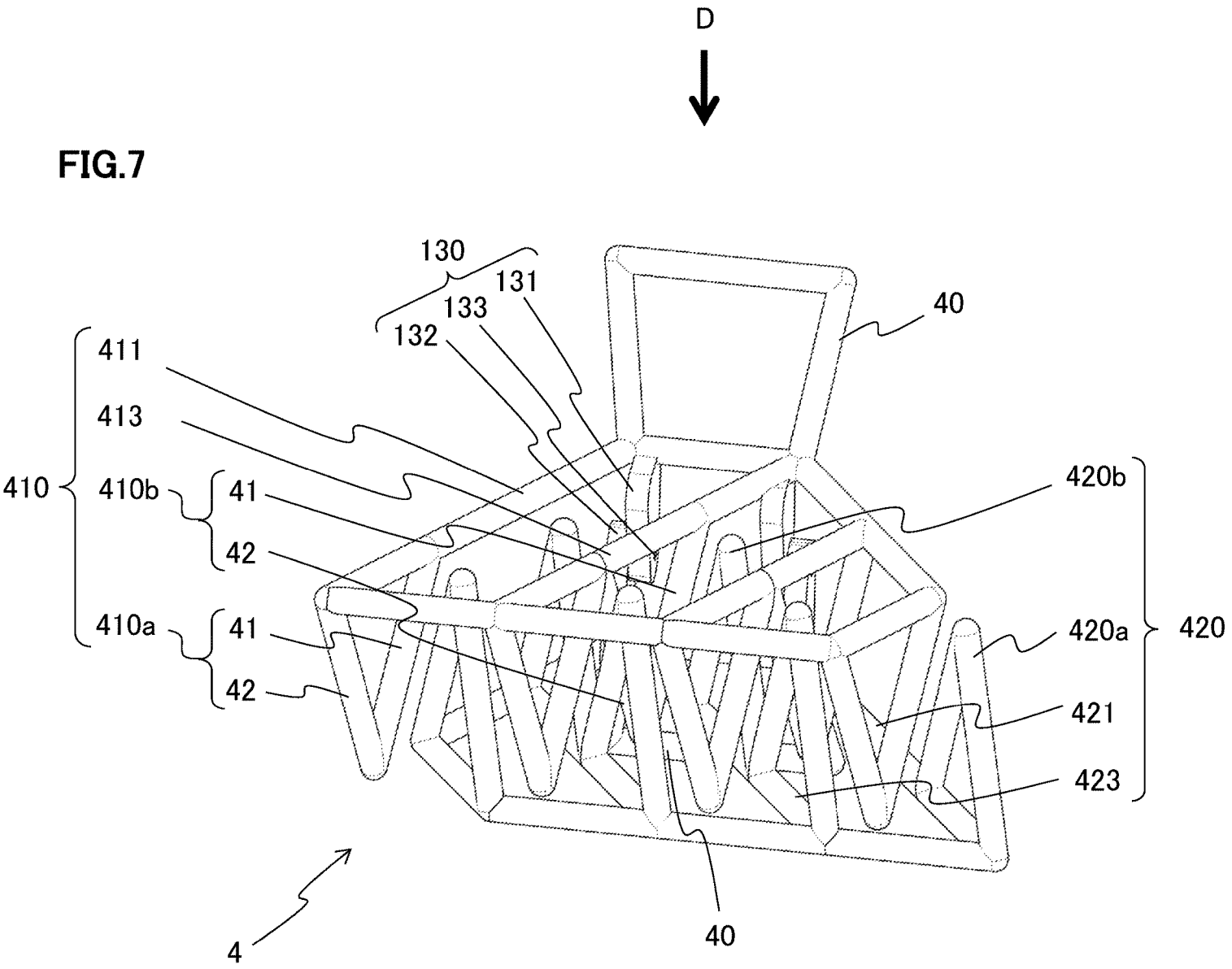
FIG. 7 is a perspective view for describing a hair clip 4 according to Embodiment 4 of the present invention.

FIG. 7 is a perspective view for describing a hair clip 4 according to Embodiment 4 of the present invention.

The hair clip 4 in Embodiment 4 is formed by modifying the hair clip 3 in Embodiment 3 in such a manner to make the length of arrangement with first and second teeth alternately arranged therein longer than the length of the other arrangement with first and second teeth alternately arranged therein. Hereinafter, the hair clip 4 in Embodiment 4 will be specifically described.

The hair clip 4 comprises first and second clip pieces 410 and 420, which correspond to the first and second clip pieces 310 and 320 in the hair clip 3 according to Embodiment 3. The hinge member 130 of the hair clip 4 is identical to the one in Embodiment 3.

(First Clip Piece 410)

The first clip piece 410, similarly to the first clip piece 310 in Embodiment 3, has a plurality of first teeth and a base for supporting the plurality of first teeth. Herein, the base is a base frame 411 similar to the base in Embodiment 3. A first bearing portion 131 of the hinge member 130 is attached to the base frame 411, and a grip portion 40 is further formed thereon.

Figure 8:
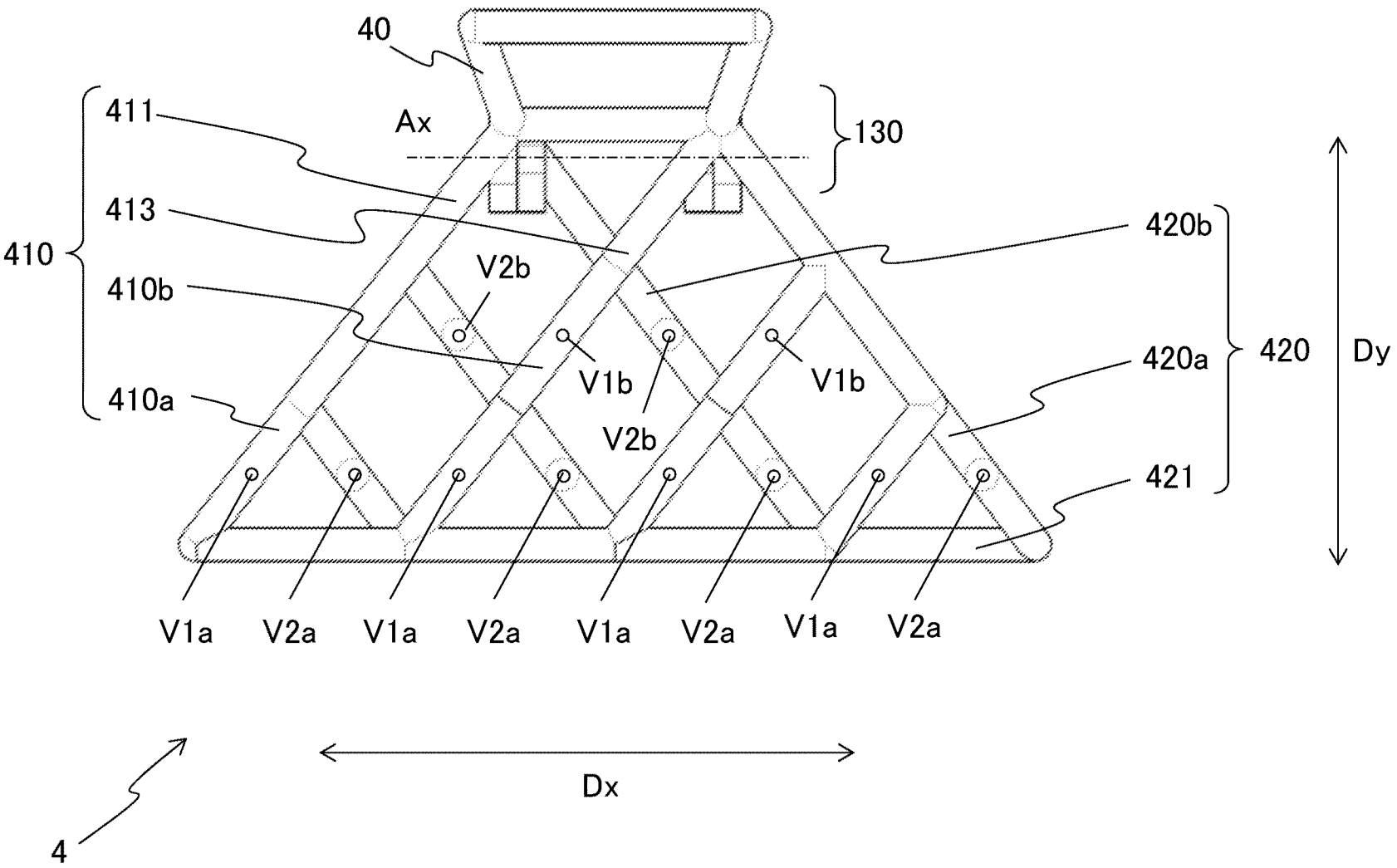
FIG. 8 is a plan view of the hair clip 4 shown in FIG. 7 as viewed from the direction D, showing the positions of apexes of generally V-shaped teeth in a pair of clip pieces 410 and 420 constituting the hair clip 4.

The first clip piece 410 includes six, first teeth disposed in two rows along the hinge axial direction Dx of the hinge member 130 (see FIG. 8). Herein, the six first teeth include four front-row first teeth (first teeth A) 410*a*, which form the row farther from the hinge axis Ax between the two rows, and two back-row first teeth (first teeth B) 410*b*, which form the row closer to the hinge axis Ax between the two rows.

The four front-row first teeth 410*a* and the two back-row first teeth 410*b* all have a generally V shape.

For example, the front-row first tooth 410*a* is formed by joining one end of a first straight frame piece 41 and one end of a second straight frame piece 42 in such a manner that the frame pieces 41 and 42 form a generally V shape. Note that the angle of the generally V-shape of the outer first tooth 410*a* is identical to the angle of the first tooth in the hair clip 1 according to Embodiment 1.

(Second Clip Piece 420)

The second clip piece 420 also has the same structure as the first clip piece 410, and the second clip piece 420 has front-row second teeth (second teeth A) 420*a*, back-row second teeth (second teeth B) 420*b*, a base frame 421, and a second bearing portion 132, which correspond to the front-row first teeth 410*a*, back-row first teeth 410*b*, base frame 411 and first bearing portion 131 of the first clip piece 410, respectively.

In the hair clip 4 as described above, the positional relationship between the plurality of first teeth and the plurality of second teeth in a state where the hair is held between the first clip piece 410 and the second clip piece 420 will be such a relationship as described below.

FIG. 8 is a plan view of the hair clip 4 shown in FIG. 7 as viewed from the direction D, showing the positions of apexes of generally V-shaped teeth in a pair of clip pieces 410 and 420 constituting the hair clip 4.

In the hair clip 4, the positions of the apexes of generally V-shaped teeth in the pair of clip pieces 410*a* and 420*b* are the same as those in the hair clip 3 of Embodiment 3. The hair clip 4 according to Embodiment 4 differs from the hair clip 3 according to Embodiment 3 in that the row closer to the front, with first and second teeth alternately arranged therein, is longer than the row closer to the back, with first and second teeth alternately arranged therein.

In Embodiment 4 with such a configuration, the row closer to the front, with first and second teeth alternately arranged therein, is longer than the row closer to the back, with first and second teeth alternately arranged therein. This allows the hair clip 4 to hold the hair at a wider width towards the tip thereof, in addition to the effect of Embodiment 3.

Note that the hair clips, having a structure with a plurality of first teeth and a plurality of second teeth arranged in two rows along the hinge axial direction, are not limited to those in which each of a plurality of first teeth as well as each of a plurality of second teeth are directly connected to a base frame, as in the hair clips according to Embodiments 3 and 4.

For example, the first clip piece (second clip piece) may be such a clip piece in which only both ends of a coupled body formed by coupling a plurality of first teeth (second teeth) are connected to a base frame. Hair clips with such a configuration will be described hereinafter in Embodiments 5 and 6 below.

Embodiment 5

Figure 9:
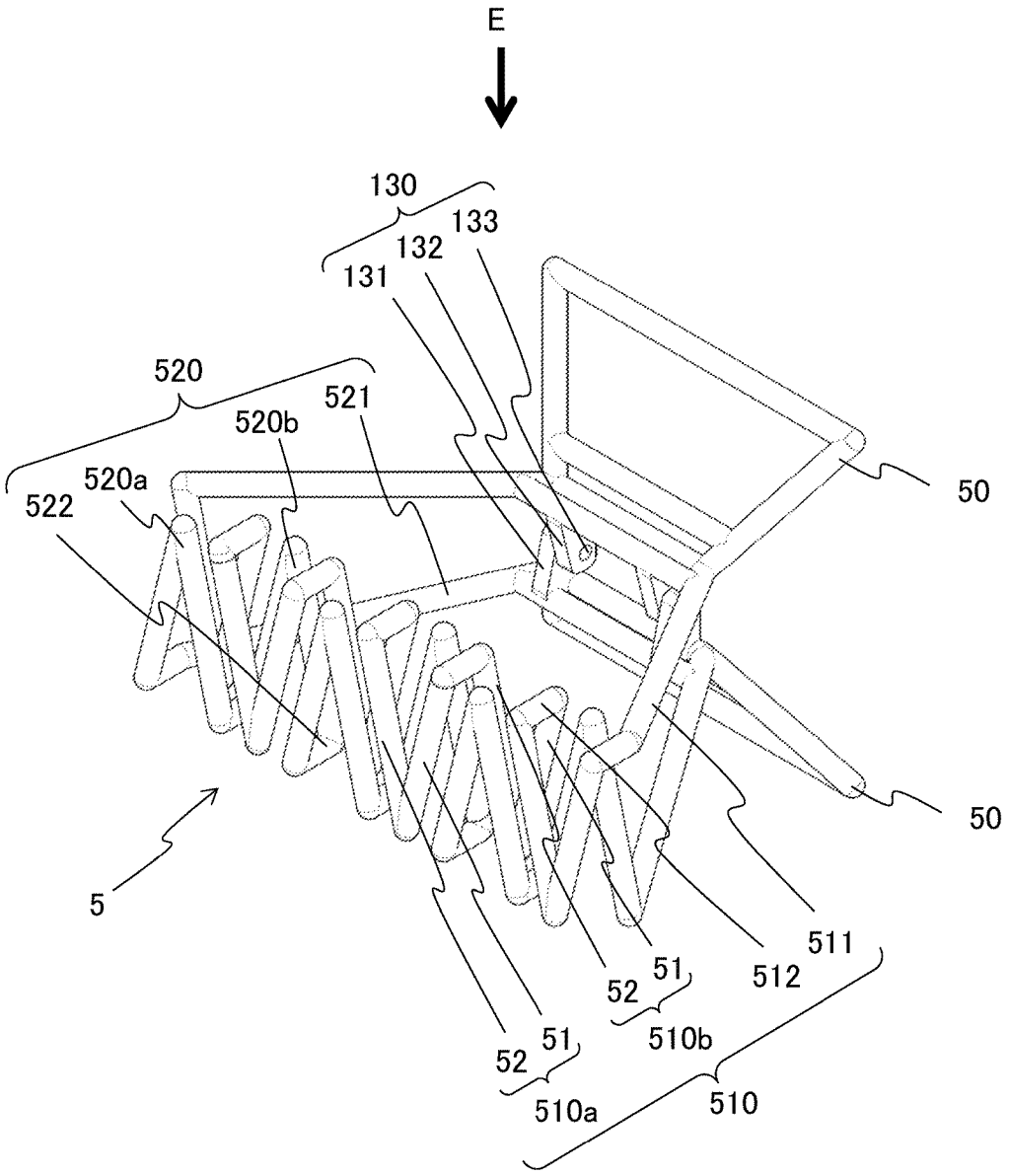
FIG. 9 is a perspective view for describing a hair clip 5 according to Embodiment 5 of the present invention.

FIG. 9 is a perspective view for describing a hair clip 5 according to Embodiment 5 of the present invention.

The hair clip 5 comprises first and second clip pieces 510 and 520, which correspond to the first and second clip pieces 110 and 120 in the hair clip 1 according to Embodiment 1. The hinge member 130 of the hair clip 5 is identical to the one in Embodiment 1.

The first clip piece 510, similarly to the first clip piece 110 in Embodiment 1, has a plurality of first teeth and a base for supporting the plurality of first teeth.

Herein, the base is a frame body (base frame) 511 formed by joining a plurality of linear frames. A first bearing portion 131, which constitutes the hinge member 130, is attached to part of the base frame 511, and a grip portion 50 is formed on the base frame 511.

The plurality of first teeth are a coupled body formed by coupling six first teeth with a coupling frame 512, and both ends of the coupled body are connected to both ends of the base frame 511. Herein, the six first teeth are arranged in a staggered manner along the hinge axial direction Dx. That is, the odd-numbered first teeth (first teeth A) 510*a* of the first clip piece 510 from the right side of the page with FIG. 9 shown thereon are located farther from the hinge member 130 than the even-numbered first teeth (first teeth B) 510*b*.

Herein, the odd-numbered first teeth (first teeth A) 510*a* have the same structure as the even-numbered first teeth (first teeth B) 510*b*, in which one end of the first straight frame piece 51 and one end of the second straight frame piece 52 are joined in such a manner that the frame pieces 51 and 52 form a generally V-shape. Note that the angles of the generally V-shape of the odd-numbered first teeth (first teeth A) 510*a* as well as even-numbered first teeth (first teeth B) 510*b* are identical to the angles of the first teeth in the hair clip 1 according to Embodiment 1.

(Second Clip Piece 520)

The second clip piece 520 also has the same structure as the first clip piece 510, and the second clip piece 520 has second teeth A 520*a*, second teeth B 520*b*, a base frame 521, a coupling frame 522, and a second bearing portion 132, which correspond to the first teeth A 510*a*, first teeth B 510*b*, base frame 511, coupling frame 512 and first bearing portion 131 of the first clip piece 510, respectively.

In the hair clip 5 as described above, the positional relationship between the plurality of first teeth and the plurality of second teeth in a state where the hair is held between the first clip piece 510 and the second clip piece 520 will be such a relationship as described below.

Figure 10:
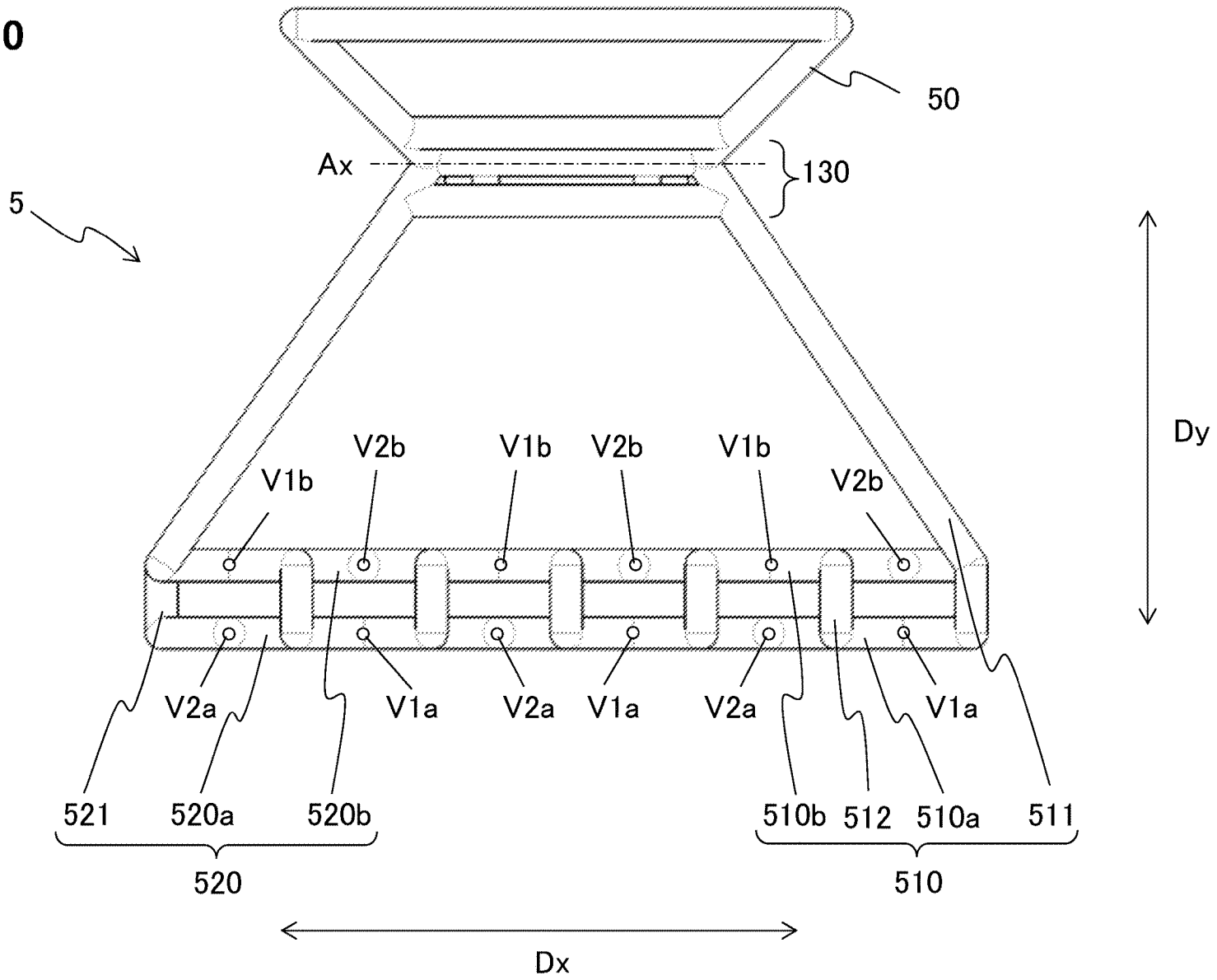
FIG. 10 is a plan view of the hair clip 5 shown in FIG. 9 as viewed from the direction E, showing the positions of apexes of generally V-shaped teeth in a pair of clip pieces 510 and 520 constituting the hair clip 5.

FIG. 10 is a plan view of the hair clip 5 shown in FIG. 9 as viewed from the direction E, showing the positions of apexes of generally V-shaped teeth in a pair of clip pieces 510 and 520 constituting the hair clip 5.

Herein, the positions of the apexes of generally V-shaped teeth in the pair of clip pieces 510*a* and 520*b* constituting the hair clip 5 are the same as those in the hair clip 3 according to Embodiment 3, as shown in FIG. 10. This accordingly allows even tighter holding of the hair with: the first and second teeth shifted in the axial direction Dx of the hinge member 130; and the first and second teeth shifted in the direction Dy perpendicular to the axial direction of the hinge member 130, whereby resulting in prolonging the state of the hair being clipped with the hair clip even longer, similarly to the hair clip 3 according to Embodiment 3.

Embodiment 6

Figure 11:
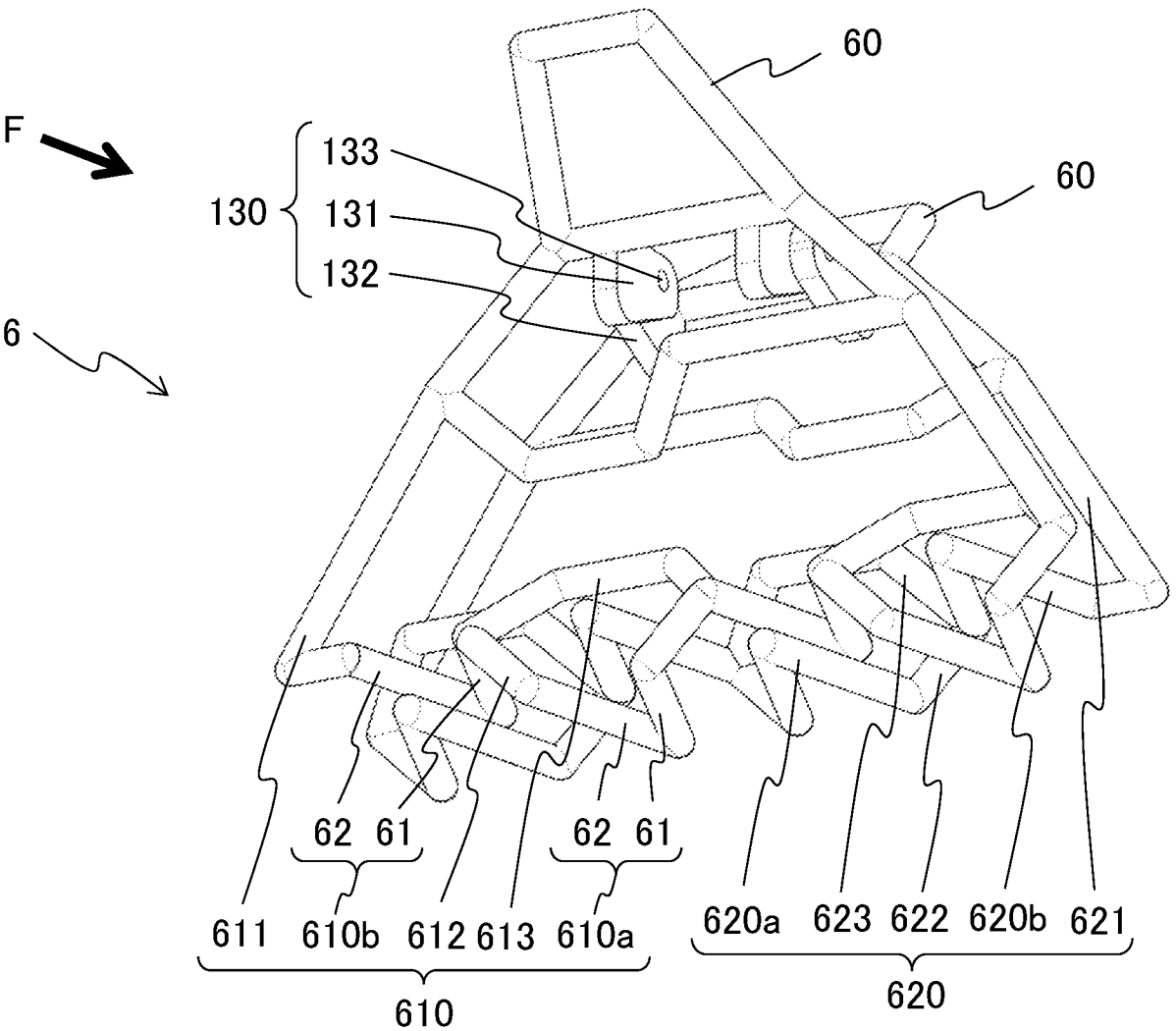
FIG. 11 is a perspective view for describing a hair clip 6 according to Embodiment 6 of the present invention.

FIG. 11 is a perspective view for describing a hair clip 6 according to Embodiment 6 of the present invention.

The hair clip 6 according to Embodiment 6 comprises a first clip piece 610 and a second clip piece 620, similarly to the hair clip 5 in Embodiment 5. In the hair clip in Embodiment 6, the first clip piece 610 is formed by provided a reinforcing frame 613 for reinforcing first teeth A 510*a* in the first clip piece 510 in Embodiment 5, while the second clip piece 620 is formed by providing a reinforcing frame 623 for reinforcing second teeth A 520*a* in the second clip piece 520 in Embodiment 5.

That is, the first clip piece 610, similarly to the first clip piece 510 in Embodiment 5, has a plurality of first teeth and a base for supporting the plurality of first teeth. Herein, the base is a frame body (base frame) 611 formed by joining a plurality of linear frames. A first bearing portion 131, which constitutes the hinge member 130, is attached to part of the base frame 611, and a grip portion 60 is formed on the base frame 611.

The plurality of first teeth is a coupled body formed by coupling four first teeth with a coupling frame 612, and both ends of the coupled body are connected to both ends of the base frame 611. Herein, the four first teeth are arranged in a staggered manner along a direction Dx parallel to the hinge axis Ax (see FIG. 12). That is, the odd-numbered first teeth (first teeth A) 610*a* of the first clip piece 610 from the right side of the page with FIG. 11 shown thereon are located farther from the hinge member 130 than the even-numbered first teeth (first teeth B) 610*b*. The first teeth (first teeth A) 610*a* are reinforced by the reinforcing frame 613.

Herein, the odd-numbered first teeth (first teeth A) 610*a* have the same structure as the even-numbered first teeth (first teeth B) 610*b*, the structure of which is formed by joining one end of a first straight frame piece 61 with one end of a second straight frame piece 62 in such a manner that the frame pieces 61 and 62 form a generally V-shape. Note that the angles of the generally V-shape of the odd-numbered first teeth (first teeth A) 610*a* as well as even-numbered first teeth (first teeth B) 610*b* are identical to the angles of the first teeth in the hair clip 1 according to Embodiment 1.

(Second Clip Piece 620)

The second clip piece 620 also has the same structure as the first clip piece 610, and the second clip piece 620 has second teeth A 620*a*, second teeth B 620*b*, a base frame 621, a reinforcing frame 623, and a second bearing portion 132, which correspond to the first teeth A 610*a*, first teeth B 610*b*, base frame 611, reinforcing frame 613 and first bearing portion 131 of the first clip piece 610, respectively. Herein, the second teeth (second teeth A) 620*a* are reinforced by the reinforcing frame 623.

In the hair clip 6 as described above, the positional relationship between the plurality of first teeth and the plurality of second teeth in a state where the hair is held between the first clip piece 610 and the second clip piece 620 will be such a relationship as described below.

Figure 12:
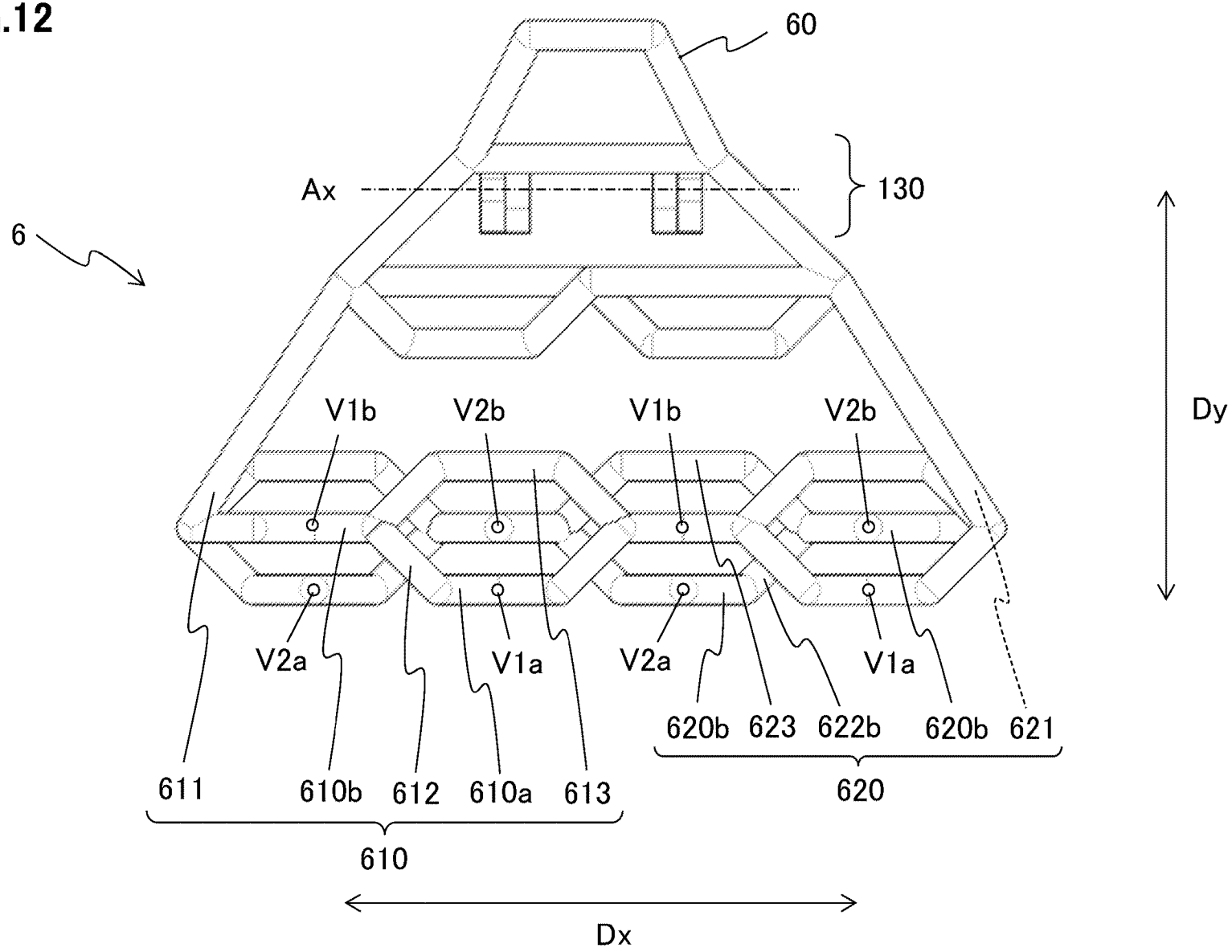
FIG. 12 is a plan view of the hair clip 6 shown in FIG. 11 as viewed from the direction F, showing the positions of apexes of generally V-shaped teeth in a pair of clip pieces 610 and 620 constituting the hair clip 6.

FIG. 12 is a plan view of the hair clip 6 shown in FIG. 11 as viewed from the direction F, showing the positions of apexes of generally V-shaped teeth in a pair of clip pieces 610 and 620 constituting the hair clip 6.

Herein, the positions of the apexes of generally V-shaped teeth in the pair of clip pieces 610 and 620 constituting the hair clip 6 are identical to those in Embodiment 3 as shown in FIG. 12. This accordingly allows even tighter holding of the hair with: the first and second teeth shifted in the direction Dx parallel to the axial direction of the hinge member 130; and the first and second teeth shifted in the direction Dy perpendicular to the axial direction of the hinge member 130, whereby resulting in prolonging the state of the hair being clipped with the hair clip even longer, similarly to the hair clip 3 according to Embodiment 3.

Furthermore, according to the hair clip 6, the first clip piece 610 comprises a reinforcing frame 613 for reinforcing first teeth A 610*a*, and the second clip piece 620 comprises a reinforcing frame 623 for reinforcing second teeth A 620*a*. Accordingly, the first teeth A 610*a* and second teeth A 620*a* can be controlled from being deformed when the first clip piece 610 and the second clip piece 620 hold the hair therebetween, which allows the teeth to hold the hair with a more enhanced force. While the number of the first teeth A and first teeth B included as a plurality of first teeth in the first clip piece as well as the number of the second teeth A and second teeth B included as a plurality of second teeth in the second clip piece are specifically shown in each of Embodiments 1 to 6 according to the present invention above, the hair clip according to the present invention may include any number of first teeth A and first teeth B as well as any number of second teeth A and second teeth B. Accordingly, the number of first teeth A, first teeth B, second teeth A, and second teeth B in the hair clip in each of Embodiments may be any number (e.g., one, two or more) other than the number shown in each of Embodiments.

While the present invention has been illustrated with preferred embodiments of the present invention, the present invention should not be construed as being limited to these embodiments. It is understood that the present invention should be interpreted only by the scope of the claims of the present invention. It will be understood by those skilled in the art that from the description of specific preferred embodiments of the present invention, an equivalent range can be implemented based on the description the present invention and common general technical knowledge. It is understood that the references cited herein should be incorporated as reference to the present specification in the same manner that the content itself is specifically described herein.

INDUSTRIAL APPLICABILITY

The present invention is useful, in the field of hair clips, as such an invention for achieving a hair clip capable of holding the hair more tightly, thereby prolonging the state of the hair being clipped with the hair clip.

REFERENCE NUMERALS

1 to 6: hair clip
110, 210, 310, 410, 510, 610: first clip piece
110*a*, 210*a*, 310*a*, 410*a*, 510*a*, 610*a*: first tooth (first tooth A)
110*b*, 210*b*, 310*b*, 410*b*, 510*b*, 610*b*: first tooth (first tooth B)
120, 220, 320, 420, 520, 620: second clip piece
120*a*, 220*a*, 320*a*, 420*a*, 520*a*, 620*a*: second tooth (second tooth A)
120*b*, 220*b*, 320*b*, 420*b*, 520*b*, 620*b*: second tooth (second tooth B)
V1*a*: first tooth A apex
V1*b*: first tooth B apex
V2*a*: second tooth A apex
V2*b*: second tooth B apex

What is claimed is:

1. A hair clip for clipping hair, comprising:

a first clip piece and a second clip piece, for holding the hair; and a hinge member connecting the first clip piece with the second clip piece in an openable and closable manner, wherein the first clip piece has a plurality of first teeth of generally V-shape, the plurality of first teeth being arranged along an axial direction of the hinge member, wherein the first clip piece has first base frames connecting the plurality of first teeth to the hinge member, wherein the second clip piece has a plurality of second teeth of generally V-shape, the plurality of second teeth being arranged along the axial direction of the hinge member, wherein the second clip piece has second base frames connecting the plurality of second teeth to the hinge member, and wherein either:

(1) the plurality of first teeth having a first row of first teeth and a second row of first teeth, where the first row of first teeth are arranged at positions farther from an axis of the hinge member than the second row of first teeth, the first row of first teeth and the second row of first teeth are arranged alternatively along the axial direction of the hinge member so that the first teeth are arranged in a staggered arrangement and the first row of first teeth and the second row of first teeth which are adjacent to the first row of first teeth are coupled with first coupling frames interspersed between the first teeth, and extending along a direction substantially perpendicular to the axial direction of the hinge member, with more than one of the first coupling frames not directly connected to the first base frames, and the plurality of second teeth having a first row of second teeth and a second row of second teeth, where the first row of second teeth are arranged at positions closer to the axis of the hinge member than the second row of second teeth, the first row of second teeth and the second row of second teeth are arranged alternatively along the axial direction of the hinge member so that the second teeth are arranged in a staggered arrangement, and the first row of second teeth and the second row of second teeth which are adjacent to the first row of second teeth are coupled with second coupling frames interspersed between the second teeth, and extending along a direction substantially perpendicular to the axial direction of the hinge member, with more than one of the second coupling frames not directly connected to the second base frames, or (2) the plurality of first teeth having a first row of first teeth and a second row of first teeth, where the second row of first teeth are arranged at positions farther from the axis of the hinge member than the first row of first teeth, the first row of first teeth and the second row of first teeth are arranged alternatively along the axial direction of the hinge member so that the first teeth are arranged in a staggered arrangement, and the first row of first teeth and the second row of first teeth which are adjacent to the first row of first teeth are coupled with first coupling frames interspersed between the first teeth, and extending along a direction substantially perpendicular to the axial direction of the hinge member, with more than one of the first coupling frames not directly connected to the first base frames, and the plurality of second teeth having a first row of second teeth and a second row of second teeth, where the second row of second teeth are arranged at positions closer to the axis of the hinge member than the first row of second teeth, the first row of second teeth and the second row of second teeth are arranged alternatively along the axial direction of the hinge member so that the second teeth are arranged in a staggered arrangement, and the first row of second teeth and the second row of second teeth which are adjacent to the first row of second teeth are coupled with second coupling frames interspersed between the second teeth, and extending along a direction substantially perpendicular to the axial direction of the hinge member, with more than one of the second coupling frames not directly connected to the second base frames.

2. The hair clip according to claim 1, wherein, in a state where the hair is held between the first clip piece and the second clip piece, the first row of first teeth and the second row of second teeth are alternately arranged along the axial direction of the hinge member so that each of the first row of first teeth is adjacent to at least one tooth of the second row of second teeth, the second row of first teeth and the first row of second teeth are alternately arranged along the axial direction of the hinge member so that each of the second row of first teeth is adjacent to at least one tooth of the first row of second teeth, the first row of first teeth and the first row of second teeth are arranged along the direction substantially perpendicular to the axial direction of the hinge member so that the first row of first teeth faces the first row of second teeth, and the second row of first teeth and the second row of second teeth are arranged along the direction substantially perpendicular to the axial direction of the hinge member so that the second row of first teeth faces the second row of second teeth.

3. The hair clip according to claim 2, wherein an angle of the generally V-shape is in the range of about 10° to about 50°.

4. The hair clip according to claim 2, wherein an angle of the generally V-shape is in the range of about 20° to about 40°.

* * * * *